US005641166A

United States Patent [19]

Reisel

[11] Patent Number: 5,641,166

[45] Date of Patent: Jun. 24, 1997

[54] DIVERSE BOARD GAME

[76] Inventor: Walter Reisel, 52 Carrick Avenue, Keswick, Ontario, Canada, L4P 3R5

[21] Appl. No.: 565,860

[22] Filed: Dec. 1, 1995

[51] Int. Cl.[6] ..... A63F 3/02

[52] U.S. Cl. ..... 273/261

[58] Field of Search ..... 273/236, 260, 273/261, 258

[56] References Cited

U.S. PATENT DOCUMENTS

| | | | |
|---|---|---|---|
| 3,588,114 | 6/1971 | Vogel | 273/261 X |
| 3,881,731 | 5/1975 | Droney | 273/260 X |
| 3,929,337 | 12/1975 | Hayes | 273/260 X |
| 4,289,314 | 9/1981 | Berlino | 273/260 |
| 4,470,602 | 9/1984 | Reed | 273/260 |
| 4,653,759 | 3/1987 | Anderson et al. | 273/261 |
| 5,080,370 | 1/1992 | Lu | 273/260 |
| 5,306,016 | 4/1994 | McInnis | 273/260 X |

FOREIGN PATENT DOCUMENTS

| | | | |
|---|---|---|---|
| 2504811 | 11/1982 | France | 273/261 |
| 12853 | of 1894 | United Kingdom | 273/261 |

*Primary Examiner*—William E. Stoll
*Attorney, Agent, or Firm*—David W. Wong

[57] ABSTRACT

This board game apparatus is adapted for two to four players to play a variety of strategy challenging and luck demanding games. It includes an eight-sided game board having a checkered grid of horizontal rows and vertical columns of squares provided on its playing surface, and two types of plurality of six sided cubic playing pieces positioned on the board. One type of the playing pieces has a first symbol provided on at least one of its six sides to represent a blocking function. The remaining playing pieces have six symbols identifying their six sides. Each different one of these symbols is provided on a different side of their six sides to represent six different functions of these playing pieces. When the playing piece is positioned on the game board with a selected symbol located on the top side, it assumes that particular function. Each function is allowed to move on the checkered grid on the board following the roll of a die or two dice and to capture opponent's playing pieces according to pre-set rules of the game.

1 Claim, 2 Drawing Sheets

DIVERSE BOARD GAME

BACKGROUND OF THE INVENTION

This invention relates to a board game apparatus which can be played in a large number of varieties and fashions according to the rules of the game to provide great entertainment and a stimulating experience for the players.

There are many different types of board games. One type of board game commonly comprises a playing board having a design pattern provided thereon, and a plurality of playing pieces adapted to move on the board according to the rules of the game. Many of such games are used for entertainment as well as for stimulating the imagination of the players. The playing pieces are to be placed at pre-set locations on the board at the commencement of the game in only one predetermined pattern. For example, in the common checker game or chess game the playing pieces are placed in a single pattern at preassigned positions on the board at the start of the game; and then each player takes alternate turns to move a playing piece according to the rules of the game. However, this type of game does not allow the playing pieces to be arranged in more than one initial set up pattern; and it is restricted to one type of game and play method. Moreover, the odds of winning the game are always drastically in favour of the more learned or experienced player.

A second type of board game is provided with a singular playing piece or alternatively a plurality of playing pieces which are placed and moved over a board having a usually complex pattern provided thereon based on the number obtained in rolling a die or more than one die. Such game provides a high degree of entertainment based on the luck in rolling the die but it does not provide any challenge to the players in having to decide the manner of making the move of the playing pieces over the board so as to arrive at a winning situation. Again this type of game is restricted to one type of game and play method. The board game under the tradename of "Monopoly" is one type of such board game.

SUMMARY OF THE INVENTION

It is a principal object of the present invention to provide a board game apparatus which provides a combination of the luck of rolling of a die as well as a challenge to the players' imagination of making the move of the playing pieces according to the rules of the game to arrive at a winning situation.

It is another object of the present invention to provide a board game apparatus which may be played in a variety of alternate initial set ups.

It is another object of the present invention to provide a board game apparatus which may be played in more than one fashion to provide various degrees of challenge to the players' imagination and aptitude.

It is yet another object of the present invention to provide a board game apparatus which is intellectually challenging and highly entertaining to the players.

It is still yet another object of the present invention to provide a board game apparatus which is simple and easy to understand.

Briefly, the board game of the present invention comprises an eight-sided game board having a first pair of mutually parallel long sides, and a second pair of mutually parallel long sides. The first pair of long sides is perpendicular to the second pair of long sides. The game board has a top playing surface provided with a substantially checkered pattern having a plurality of rows and columns of squares therein. A plurality of substantially cubic playing pieces are adapted to be positioned on the squares of the game board in at least two opposing groups for playing game. These group of the playing pieces have different colours or shade to differentiate between those of one player's pieces from the opponent's pieces. All of the playing pieces have six sides, and they consist of two groups in which the first group each playing piece has a distinct symbol provided on at least one side therein to represent its characteristic, and in the second group, each playing piece has six symbols thereon with a different symbol provided on a different one of its six sides.

BRIEF DESCRIPTION OF THE DRAWINGS

The above mentioned and other objects and features of this invention and the manner of attaining them will become apparent, and the invention itself will be best understood by reference to the following description of the exemplary embodiments of the invention in conjunction with the accompanying drawings, in which.

DESCRIPTION OF THE PREFERRED EMBODIMENT

Figure 1:
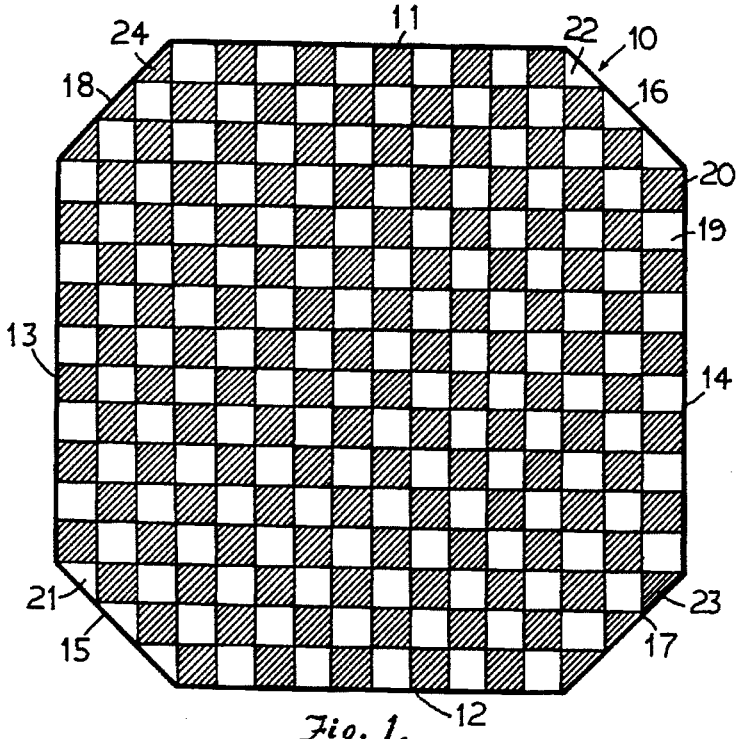
FIG. 1 is a perspective plan elevation view of the game board of the present apparatus having a grid pattern on which the playing pieces move.

Referring now to the drawings wherein like reference numerals designate like parts in the various views, the game board 10 of the present invention is best shown in FIG. 1. The game board 10 is eight-sided having two long sides 11 and 12 mutually parallel to each other, and another two long sides 13 and 14 mutually parallel to each and perpendicular to the long sides 11 and 12; two short sides 15 and 16 mutually parallel to each other, and another two short sides 17 and 18 also mutually parallel to each other and perpendicular to the short sides 15 and 16. The game board 10 may be constructed with a square board with the four corners removed to form the two pairs of short sides. A checkered grid of sixteen horizontal rows of squares and sixteen vertical rows of squares are marked on the board, and then the corners are removed diagonally at the third vertical and horizontal squares in the four sides to form the board of the present invention having two hundred and thirty two squares and twelve right-angled triangles. Alternate squares are shaded or coloured to form a checkered pattern of parallel rows of light squares 19 and shaded or coloured squares 20, and three light triangles 21 on the short side 15 and three light triangles 22 on the opposite short side 16. Three shaded or coloured triangles 23 are located on the short side 17 and three shaded or coloured triangles 24 located on the opposite side 18. It can be appreciated by those skilled in the art that a larger board with more squares or a smaller board with fewer squares may be provided for playing the game according to the present invention.

Figure 2:
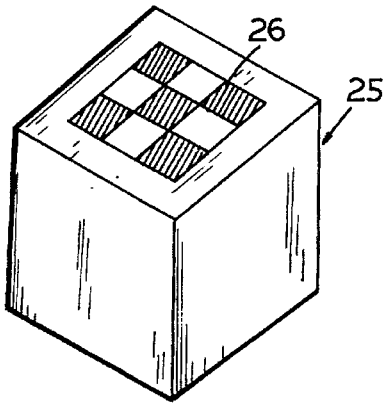
FIG. 2 is an enlarged perspective view of the blister blocker playing piece represented by a checkered symbol thereon according to the present invention.

There are two types of playing pieces which are generally referred to as the "blisterpieces" in the game and are substantially cubic in shape having six faces. One type of the blisterpieces is referred to in the game as the "blister blocker" or a "blocker" which serves to provide a blocking function to block the path of other playing pieces. The blister blocker 25 as best shown in FIG. 2 has a checkered symbol 26 provided on at least one side face therein, and preferably the same symbol may be provided on all of its six side faces so as to facilitate its ready identification regardless of on which side it is resting on the game board.

Figure 3:
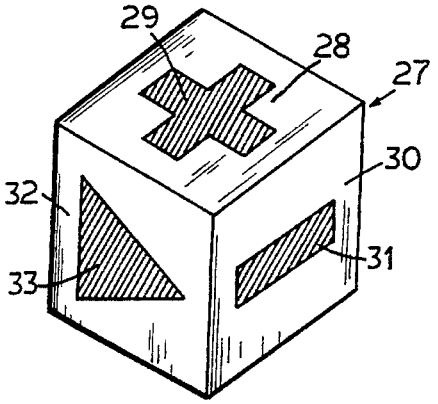
FIG. 3 is an enlarged perspective view of the active playing blister piece of the present invention showing three symbols thereon.
Figure 4:
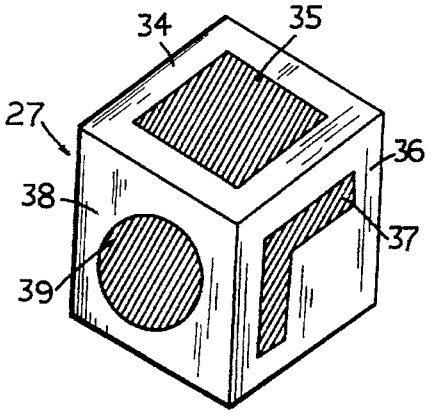
FIG. 4 is another enlarged perspective view of the active playing blister piece of the present invention showing the other three symbols thereon.

The second type of the blisterpieces are the "active blisterpieces" as best shown in FIGS. 3 and 4. Each active blisterpiece 27 has a different symbol provided on each different one of its six side faces. The active blisterpiece assumes a different characteristic depending on which symbol is located on its top side face when the active blisterpiece is resting on the game board. As best shown in FIG. 3, on one side face 28 a cross symbol 29 is provided therein. When the blisterpiece 27 is resting on the game board 10 with this cross symbol located on its top face, the playing piece is referred to as the "blister cross" or a "cross". On the second side face 30 a bar symbol 31 is provided therein. When the active blisterpiece 27 is resting on the game board 10 with this bar symbol located on the top face, the playing piece is referred to as the "blister poke" or a "poke". On the third side face 32 a triangular symbol 33 is provided therein. When the active blisterpiece is resting on the game board with this triangular symbol 33 located on the top face the playing piece is referred to as the "blister point" or a "point". As shown on FIG. 4, on the fourth face 34 a substantially square symbol 35 is provided therein. When the active blisterpiece is resting on the game board with this substantially square symbol showing on the top face, it is referred to as the "blister box" or a "box". On the fifth side face 36 an L-shaped symbol 37 is provided therein. When the active blisterpiece is resting on the game board with this L-shaped symbol showing on its top surface, it is referred to as the "blister angle" or an "angle". On the sixth side face 38 a circular symbol 39 is provided therein. When the active blisterpiece is resting on the game board with this circular symbol showing on its top face, it is referred to as the "blister ball" or a "ball".

The game may be played by two or four players. When it is played by two players, the playing pieces may be initially arranged on opposite border portions of the game board in a selected one of the variety of set up patterns as shown in FIGS. 5, 6, 7 and 8. Each player is assigned a set of blisterpieces of a different colour from those of the opponent's so as to distinguish between the opposing blisterpieces. When the game is played by four players, two players may form partners against the other two players as the opposing partners.

The object of the game is to capture and eliminate the opponent's playing pieces. The player who has eliminated all of the opponent's active playing pieces wins the game.

In playing the game, the player, after rolling a die, selects to move a playing piece for a number of squares from its position to a second position according to the number obtained from the rolled die. Two dice may be used, and after rolling the dice, a selected playing piece may be moved according to the number shown on one die and again be moved consecutively thereafter a second time according to the number shown on the other die.

The various playing pieces are to be moved according to the following travel patterns: the blister box, blister ball, blister point, and blister blocker are allowed to be moved lineally in either the vertical direction, or the horizontal direction or the diagonal direction. Whereas the blister cross, blister angle and blister poke may only be moved lineally in the vertical direction or horizontal direction. Both the blister angle and blister cross are to be moved in a right angle fashion. For example, when a 3 is obtained in rolling the die, a blister angle or blister cross is first moved in the horizontal direction for three squares to a second position and then again three squares in the vertical direction from this second position to complete its move. Alternatively, it may be first moved for three squares in the vertical direction to a second position and then again three squares in the horizontal direction from this second position to complete its move. The blister cross also has the option of travelling lineally only without making the further right angle move. For the above example, the blister cross may simply be moved three squares lineally to the second position.

The rules of the game are as follows:

(1) Each player takes an alternate turn to roll the die and makes the move of a selected playing piece according to the number shown on the die. When two dice are used, the selected playing piece is to be moved a number of squares according to one number shown in one die and again consecutively another number of squares according to the second number shown in the other die.

(2) Each playing piece including the blister block and active blisterpiece may be moved in one linear direction in each player's turn. The blister cross and blister point may be moved in a first linear direction and again in another selected linear direction perpendicular to the first linear direction.

(3) If a player, after casting a die, is unable to move any playing piece according to the number indicated by the rolled die, then the die may be rolled again until a playing piece can be moved.

(4) Players must complete each move without moving beyond the perimeter of the game board.

(5) The blister ball playing piece may move once or repeatedly in a selected linear direction on the board, and over other active blisterpieces according to the number shown on the rolled die.

(6) A blister blocker cannot pass over on top of any active blisterpiece, and likewise an active blisterpiece cannot pass over on top of any blister blocker.

Figure 9:
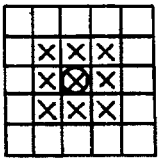
FIG. 9 is a schematic diagram showing the capture or take out pattern of an opponent's playing piece by a blister box playing piece according to the rules of the game.
Figure 10:
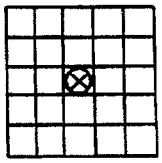
FIG. 10 is a schematic diagram showing the capture or take out pattern of an opponent's playing pieces by a blister ball playing piece according to the rules of the game.
Figure 11:
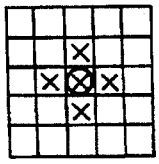
FIG. 11 is a schematic diagram showing the capture or take out pattern of an opponent's playing pieces by a blister cross or blister angle playing piece according to the rules of the game.
Figure 12:
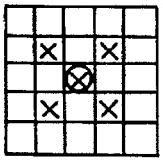
FIG. 12 is a schematic diagram showing the capture or take out pattern of an opponent's playing pieces by a blister point playing piece according to the rules of the game.
Figure 13:
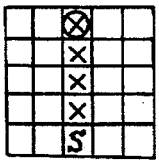
FIG. 13 is a schematic diagram showing the capture or take out pattern of an opponent's playing piece by a blister poke playing piece.

(7) The various active blisterpieces have the capture characteristics as shown in FIGS. 9 through 13. As shown in FIG. 9, when a blister box lands at a landing position shown by a circle at the end of its move, it will capture and eliminate the opponent's active blisterpiece located at this landing position shown by the "X" mark superimposed in the circle in drawing. If no opponent's active blisterpiece is located at this landing position, then any selected one of the opponent's active blisterpiece located at any one of the eight positions marked by an "X" mark surrounding the landing position of the blister box may be captured and eliminated. As shown in FIG. 10, an opponent's active blisterpiece is captured and eliminated only when a blister ball lands on it. As shown in FIG. 11 when a blister cross or blister angle lands on a position marked by a circle, it may capture and eliminate the opponent's active blisterpiece shown by an "X" mark superimposed in the circle, located at this landing position. If no opponent's active blisterpiece is located at the landing position, then any selected one of the opponent's active blisterpieces located in any one of the squares adjacent to the sides of the square at which the blister cross or blister angle lands at the end of its move. As shown in FIG. 12 when a blister point lands on a position as shown by the circle, it may capture and eliminate the opponent's active blisterpiece, shown by the "X" mark superimposed in the circle mark, located at this landing position. If no opponent's active blisterpiece is located at this landing position, then any selected one of the opponent's active blisterpieces located in any one of the squares adjacent to the corners of the square at which the blister point lands at the end its move as shown by the "X" marks. As shown in FIG. 13 an opponent's active blisterpiece marked by an "X" mark is captured and eliminated when a blister poke lands on its landing position marked by a circle superimposed on the X mark at the end of its move from an initial starting point indicated by an "S" mark or the opponent's blisterpiece may be removed from the traversed distance to reach the landing position as shown by the "X" marks. Blister blockers have no capture function, they merely serve strategically to block the movement of the opponent's blisterpieces. Therefore it is not necessary to remove the blister blockers in order to win the game.

(8) When two dice are used in the game, and a pair of the same number is obtained upon rolling the dice, the player may select any active blisterpiece to change its characteristic from one characteristic to another such as from a blister poke to a blister ball prior to making a move.

(9) At any time when a pursuing player's active blisterpiece comes within six squares to an opponent's active blisterpiece, a "Blistermatch" may be invoked by stating "Blister". Under such declaration, both active blisterpieces must remain within six squares of each other and may not be moved farther away from each other, and both players must then "battle it out" with these two playing pieces until one of these opponent's active blisterpiece is captured.

In starting a game, each player is provided with ten active blisterpieces 27 and nine or ten blister blockers 25 in playing a game. Four groups of the playing pieces may be provided so that the game may be played by up to four players. Two of the four players may form a team to play against the other team formed by the other two players. Each group of the playing pieces is provided in a different colour or shade in order to differentiate the playing pieces of one player from the other.

Figure 5:
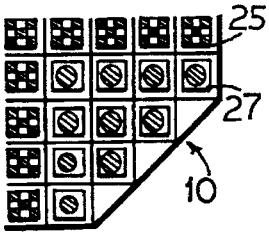
FIG. 5 is a pictorial partial view of the game board with one initial pattern of positioning the playing pieces at the commencement of playing a genetic game with the blister blocker and blister ball pieces as an exemplary illustration.
Figure 6:
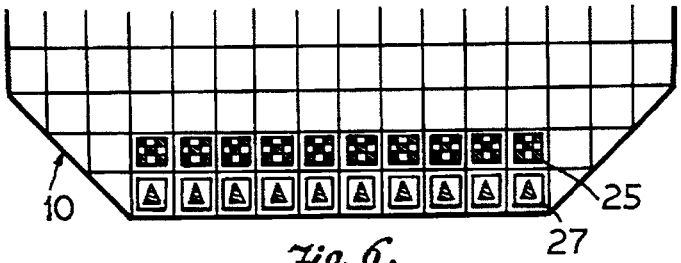
FIG. 6 is another pictorial partial view of the game board with another pattern of positioning the playing pieces at the commencement of playing another genetic game with the blister blocker and blister point pieces as an exemplary illustration.

The game may be set up from a variety of arrangements which can be divided into two basic styles. The first style is referred to as the "genetic game" in which only the blister blockers and one selected type of active blisterpieces are used. The second style is referred to as the "blisterproper game" in which the blister blockers and all different types of active blisterpieces are used. The genetic game is the initiation style of game for the beginners to familiarize themselves with the movement and the rules of the game of each type of active blisterpiece. Once the players are familiar with movement of all different types of active blisterpieces and the rules of the game, then they may advance to the blisterproper game by using the complete set of all types of blisterpieces. FIGS. 5 and 6 show two exemplary ways of setting up the genetic game. As shown in FIG. 5, and for illustration purposes, nine blister balls may be selected for playing the game, which are positioned in the squares at the short border portion of the game board 11. The blister blocks 25 barricade the active blisterpieces 27. The opponents have their playing pieces placed similarly on the opposite short border portions of the game board. In the second arrangement as best shown in FIG. 6, blister points are shown for illustration purposes, ten active blisterpieces are placed along a long border portion of the game board 11 and a row of ten blister blockers 25 are placed in front of these blisterpieces 27, and the opponent's play pieces are similarly positioned on the opposite long border of the game board 11. The genetic game may be played with the active blisterpieces alone without the use of the blister blockers in order to fully familiarize the players with the movements and the characteristics of the active blisterpieces and the rules of the game.

Figure 7:
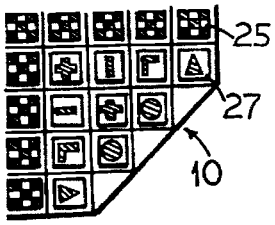
FIG. 7 is a pictorial partial view of the game board with a pattern of positioning all the different playing pieces at the commencement of playing a blisterproper game.
Figure 8:
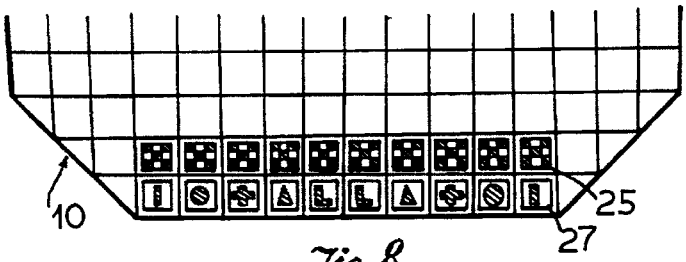
FIG. 8 is another pictorial partial view of the game board showing another pattern of positioning all the different the playing pieces at the commencement of playing another blisterproper game.

In the blisterproper game, the play pieces may be arranged at the start of the game as shown in FIGS. 7 and 8. The blisterproper game is similar to the genetic game described above, except a complete set of all the different types of the active blisterpieces are provided which consists of two blister crosses, two blister pokes, two blister angles, two blister points, one blister box and one blister ball. The blisterproper game may also be played without the use of the blister blockers.

The genetic game as well as the blisterproper game with and without the use of blister blockers may be initiated by the players of the game taking turns alternately in placing one play piece at a time in a square any where on the game board randomly or selectively until all the play pieces have been accordingly located on the game board.

Another method or style in initiating the game is by placing all the active blisterpieces in the centre of the game board and then they are randomly shuffled. After shuffling, the playing pieces are positioned by placing each of them orderly in the closest squares. The game will start with the playing pieces thistle arranged. The blister blockers may be mixed in the original random group or they may be placed by the players in alternate turns, one at a time, in chosen positions.

When two dice are used, the players are to move a selected play piece in two consecutive moves according to the numbers shown in the rolled dice. For example, one die shows a two, and the other die shows a four, the selected play piece may be moved two squares to a new position in one direction and then consecutively again four squares in the same or a different direction from the new position. Alternatively, it may be moved four squares in one direction to the new position and then consecutively again two squares in the same direction or a different direction from the new position.

The players may decide among themselves which player is to start the game or they may cast the die or two dice in turn to obtain an odd number or even number to start the game.

Figure 14:
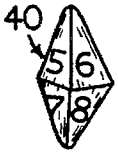
FIG. 14 is a perspective elevation view of an eight-sided die usable for determining which type of game to play and showing four numbers thereon.
Figure 15:
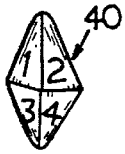
FIG. 15 is another perspective elevation view of the eight-sided die showing the other four numbers thereon.

An eight-sided die 40 as shown in FIGS. 14 and 15 may be provided for the players to decide which game to play. The eight-sided die has numbers 1 through 8 provided thereon. The number obtained after casting this special die may be as follows or according to other predetermined ways, for example, when a number 1 is obtained, the game is to be played with the blister boxes; when a number 2 is obtained, the game is to be played with the blister balls; when a number 3 is obtained, the game is to be played with the blister points; when a number 4 is obtained, the game is to be played with the blister pokes; when a number 5 is obtained the game is to be played with the blister crosses; when a number 6 is obtained, the game is to be played with the blister angles; when a number 7 is obtained, a blisterpiece is rolled to see which type of game is to be played; when a number 8 is obtained, a blisterproper game is to be played.

Obviously, numerous modifications and variations of the present invention are possible in light of the above teachings. It is therefore to be understood that within the scope of the appended claims, the invention may be practiced otherwise than as specifically described herein. For example, the active blisterpieces may have symbols different than those specifically shown but may have similar characteristics according to the teaching of the present invention.

I claim:

1. A board game comprising, an eight-sided game board having a first pair of mutually parallel long sides, and a second pair of mutually parallel long sides, said first pair of long sides being substantially perpendicular to said second pair of long sides, a first pair of mutually parallel short sides and a second pair of mutually parallel short sides, said first pair of short sides being substantially perpendicular to said second pair of short sides, said game board having a top play surface provided with a checkered pattern including two hundred and thirty-two alternately coloured squares consisting of sixteen horizontal rows of squares parallel to said first pair of mutually parallel long sides and sixteen vertical rows of squares parallel to said second pair of mutually parallel long sides, and three right-angled triangles located at each one of said short sides wherein said triangles located at said first pair of short sides are of a different colour than said triangles located at said second pair of short sides, a plurality of substantially cubic six-sided playing pieces adapted to be positioned on said squares of said game board, said playing pieces consisting of two groups wherein a first group has a checkered symbol provided on at least one side face, and a second group including a square symbol provided on one side face, a circular symbol provided on a second side face, an L-shaped symbol provided on a third side face, a bar symbol provided on a fourth side face, a triangle symbol provided on a fifth side face, and a cross symbol provided on a sixth side face, each one of said playing pieces assuming a different moving characteristic when it is resting on said game board with a different symbol appearing on its top face.

* * * * *